US012228317B2

(12) United States Patent
Wang

(10) Patent No.: US 12,228,317 B2
(45) Date of Patent: Feb. 18, 2025

(54) REFRIGERATOR COOLING SYSTEM AND METHOD FOR DEFROSTING REFRIGERATOR

(71) Applicants: HEFEI MIDEA REFRIGERATOR CO., LTD., Hefei (CN); HEFEI HUALING CO., LTD., Hefei (CN); MIDEA GROUP CO., LTD., Guangdong (CN)

(72) Inventor: Jindong Wang, Hefei (CN)

(73) Assignees: HEFEI MIDEA REFRIGERATOR CO., LTD., Anhui (CN); HEFEI HUALING CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 236 days.

(21) Appl. No.: 18/004,034

(22) PCT Filed: Nov. 16, 2021

(86) PCT No.: PCT/CN2021/130802
§ 371 (c)(1),
(2) Date: Dec. 30, 2022

(87) PCT Pub. No.: WO2022/100749
PCT Pub. Date: May 19, 2022

(65) Prior Publication Data

US 2023/0258375 A1 Aug. 17, 2023

(30) Foreign Application Priority Data

Nov. 16, 2020 (CN) ..... 202011283321.9

(51) Int. Cl.
*F25B 41/20* (2021.01)
*F25B 41/37* (2021.01)
(Continued)

(52) U.S. Cl.
CPC ..... *F25B 41/20* (2021.01); *F25B 41/37* (2021.01); *F25B 47/02* (2013.01); *F25B 49/02* (2013.01);
(Continued)

(58) Field of Classification Search
CPC ..... F25B 41/20; F25B 41/37; F25B 47/02; F25B 49/02; F25B 2347/02;
(Continued)

(56) References Cited

U.S. PATENT DOCUMENTS

| | | | |
|---|---|---|---|
| 4,215,555 | A | 8/1980 | Cann et al. |
| 2018/0328636 | A1 | 11/2018 | Ohura et al. |
| 2020/0348053 | A1 | 11/2020 | Dong et al. |

FOREIGN PATENT DOCUMENTS

| | | | |
|---|---|---|---|
| CN | 1482015 A | * | 3/2004 |
| CN | 104613688 A | | 5/2015 |

(Continued)

OTHER PUBLICATIONS

Beijing Chemical Industry Press, "Automatic control of refrigeration and air conditioning units," 2000, pp. 104 (With English abstract and translation), 4 pages.

*Primary Examiner* — Kun Kai Ma
(74) *Attorney, Agent, or Firm* — Seed IP Law Group LLP

(57) ABSTRACT

Disclosed are a refrigerator cooling system and a method for defrosting a refrigerator. The refrigerator cooling system includes a refrigerant circulation flow path provided with a compressor, a condenser, a throttling device and an evaporator. The throttling device has a throttling working mode for cooling and a defrosting working mode not used for cooling. The throttling working mode and the defrosting working mode are switched with each other. The condenser has a first heat release mode corresponding to the throttling working mode and a second heat release mode corresponding to the
(Continued)

defrosting working mode, and a heat release amount of a refrigerant flowing through the condenser in the second heat release mode is lower than a heat release amount of the refrigerant flowing through the condenser in the first heat release mode.

16 Claims, 8 Drawing Sheets

(51) Int. Cl.
*F25B 47/02* (2006.01)
*F25B 49/02* (2006.01)

(52) U.S. Cl.
CPC ..... *F25B 2347/02* (2013.01); *F25B 2400/01* (2013.01); *F25B 2400/0411* (2013.01); *F25B 2700/2117* (2013.01)

(58) Field of Classification Search
CPC ..... F25B 2400/01; F25B 2400/0411; F25B 2700/2117; F25B 41/22; F25B 2347/022; F25B 2400/054; F25B 2600/2501; F25D 21/004; F25D 21/12
See application file for complete search history.

(56) References Cited

FOREIGN PATENT DOCUMENTS

| | | | | | |
|---|---|---|---|---|---|
| CN | 206676353 | U | | 11/2017 | |
| CN | 108931075 | A | | 12/2018 | |
| CN | 109579385 | A | | 4/2019 | |
| CN | 111649516 | A | | 9/2020 | |
| EP | 1043550 | A1 | | 10/2000 | |
| JP | 2018194246 | A | * | 12/2018 | ..... B60H 1/00392 |
| KR | 20080050158 | A | * | 6/2008 | |
| WO | 2013065233 | A1 | | 5/2013 | |
| WO | 2015062662 | A1 | | 5/2015 | |

* cited by examiner

REFRIGERATOR COOLING SYSTEM AND METHOD FOR DEFROSTING REFRIGERATOR

CROSS-REFERENCE TO RELATED APPLICATIONS

This application claims priority to Chinese Patent Application No. 202011283321.9, filed on Nov. 16, 2020, the entire contents of which are incorporated herein by reference.

TECHNICAL FIELD

The present disclosure relates to the technical field of refrigerators, in particular to a refrigerator cooling system and a method for defrosting a refrigerator.

BACKGROUND

The existing defrosting technology applied in air-cooled refrigerators is mainly realized by a defrosting heater and a defrosting control system, which adopts an external heater, resulting in a high energy consumption and a poor user experience.

SUMMARY

The present disclosure provides a refrigerator cooling system and a method for defrosting a refrigerator, aiming to optimize the refrigerator cooling system for an automatic defrosting, save electric energy and improve the user experience.

The present disclosure provides a refrigerator cooling system including a refrigerant circulation flow path provided with a compressor, a condenser, a throttling device and an evaporator. The throttling device has a throttling working mode and a defrosting working mode, and the throttling working mode and the defrosting working mode are switched with each other. The condenser has a first heat release mode corresponding to the throttling working mode and a second heat release mode corresponding to the defrosting working mode, and a heat release amount of a refrigerant flowing through the condenser in the second heat release mode is lower than a heat release amount of the refrigerant flowing through the condenser in the first heat release mode.

In an embodiment, the refrigerator cooling system further includes a temperature sensor configured to detect a surface temperature of the evaporator, and a control component electrically connected to the temperature sensor and the throttling device. The control component is configured to switch a working mode of the throttling device according to a temperature obtained by the temperature sensor.

In an embodiment, the refrigerator cooling system further includes a backflow trunk section, a gasification branch and a switching structure. The backflow trunk section is communicated with the evaporator and the compressor, and the gasification branch is provided in parallel with the backflow trunk section, a heating device being provided on the gasification branch to gasify a liquid refrigerant. In response to the throttling device being in the throttling working mode, the switching structure switches the refrigerant from the backflow trunk section to flow back to the compressor. In response to the throttling device being in the defrosting working mode, the switching structure switches the refrigerant from the gasification branch to flow back to the compressor.

In an embodiment, the heating device includes a heater.

In an embodiment, two heat exchange tubes are provided in the condenser, and one of the two heat exchange tubes is provided in the refrigerant circulation flow path and located between the compressor and the throttling device. The heating device includes at least another of the two heat exchange tubes.

In an embodiment, the switching structure includes a second three-way valve and a third three-way valve. The second three-way valve is provided with three second communication ports communicated with each other, two of the three second communication ports being communicated with the backflow trunk section. The third three-way valve is provided with three third communication ports communicated with each other, two of the three third communication ports being communicated with the backflow trunk section. Both ends of the gasification branch are respectively communicated with a remaining second communication port and a remaining third communication port.

In an embodiment, the second three-way valve and/or the third three-way valve are electromagnetic three-way valves.

In an embodiment, the throttling device includes an electronic expansion valve. In response to the throttling device being in the throttling working mode, the electronic expansion valve is provided with a first opening degree to throttle the refrigerant flowing through the electronic expansion valve. In response to the throttling device being in the defrosting working mode, the electronic expansion valve is provided with a second opening degree bigger than the first opening degree, to reduce a throttling of the refrigerant flowing through the electronic expansion valve relative to the throttling working mode.

In an embodiment, the throttling device includes a first three-way valve and a throttling branch. The first three-way valve is provided with three first communication ports communicated with each other, two of the three first communication ports being communicated with the refrigerant circulation flow path. The throttling branch is provided with a capillary tube, an end of the throttling branch being communicated with a remaining first communication port, another end of the throttling branch being communicated with the evaporator. In response to the throttling device being in the throttling working mode, the first three-way valve switches the refrigerant on the refrigerant circulation flow path from the condenser to flow through the throttling branch, and then flow through the evaporator. In response to the throttling device being in the defrosting working mode, the first three-way valve switches the refrigerant on the refrigerant circulation flow path from the condenser to directly flow through the evaporator.

In an embodiment, the first three-way valve is an electromagnetic three-way valve.

The present disclosure further provides a method for defrosting a refrigerator, applied to the refrigerator cooling system as mentioned above. The method includes following operations: obtaining an actual working time of the throttling device in the throttling working mode, and in response that the actual working time reaches a preset time, switching the throttling working mode to the defrosting working mode.

In an embodiment, after the operation of in response that the actual working time reaches the preset time, switching the throttling working mode to the defrosting working mode, the method further includes: obtaining the surface temperature of the evaporator, and in response that the surface temperature of the evaporator reaches a preset temperature, switching the defrosting working mode of the throttling device to the throttling working mode.

In an embodiment, the method for defrosting a refrigerator further includes in response that the throttling device is in the defrosting working mode, gasifying the refrigerant flowing back to the compressor.

In the technical solution of the present disclosure, the refrigerant circulation flow path is provided with a compressor, a condenser, a throttling device and an evaporator. The throttling device has a throttling working mode and a defrosting working mode. The throttling working mode and the defrosting working mode are switched with each other. The condenser has a first heat release mode corresponding to the throttling working mode and a second heat release mode corresponding to the defrosting working mode. In the throttling working mode, a heat release amount of a refrigerant flowing through the condenser is high and the refrigerant in the throttle device is greatly cooled. In this case, the temperature of the refrigerant is relatively low, and the refrigerant flows through the evaporator to cool the refrigerator. In a defrosting working mode, a heat release amount of a refrigerant flowing through the condenser is low and the refrigerant in the throttle device is less cooled. In this case, the temperature of the refrigerant is relatively high, and the internal circulation of the refrigerant can be directly used for defrosting, which not only reduces the use of external heaters and has a high heating efficiency and a high defrosting speed, but also saves electric energy and improves the user experience.

BRIEF DESCRIPTION OF THE DRAWINGS

In order to more clearly illustrate the technical solutions in the embodiments of the present disclosure or in the prior art, the following briefly introduces the accompanying drawings that need to be used in the description of the embodiments or the prior art. Obviously, the drawings in the following description are only some embodiments of the present disclosure. For those of ordinary skill in the art, other drawings can also be obtained based on the structures shown in these drawings without any creative effort.

Description of reference signs

Figure 1:
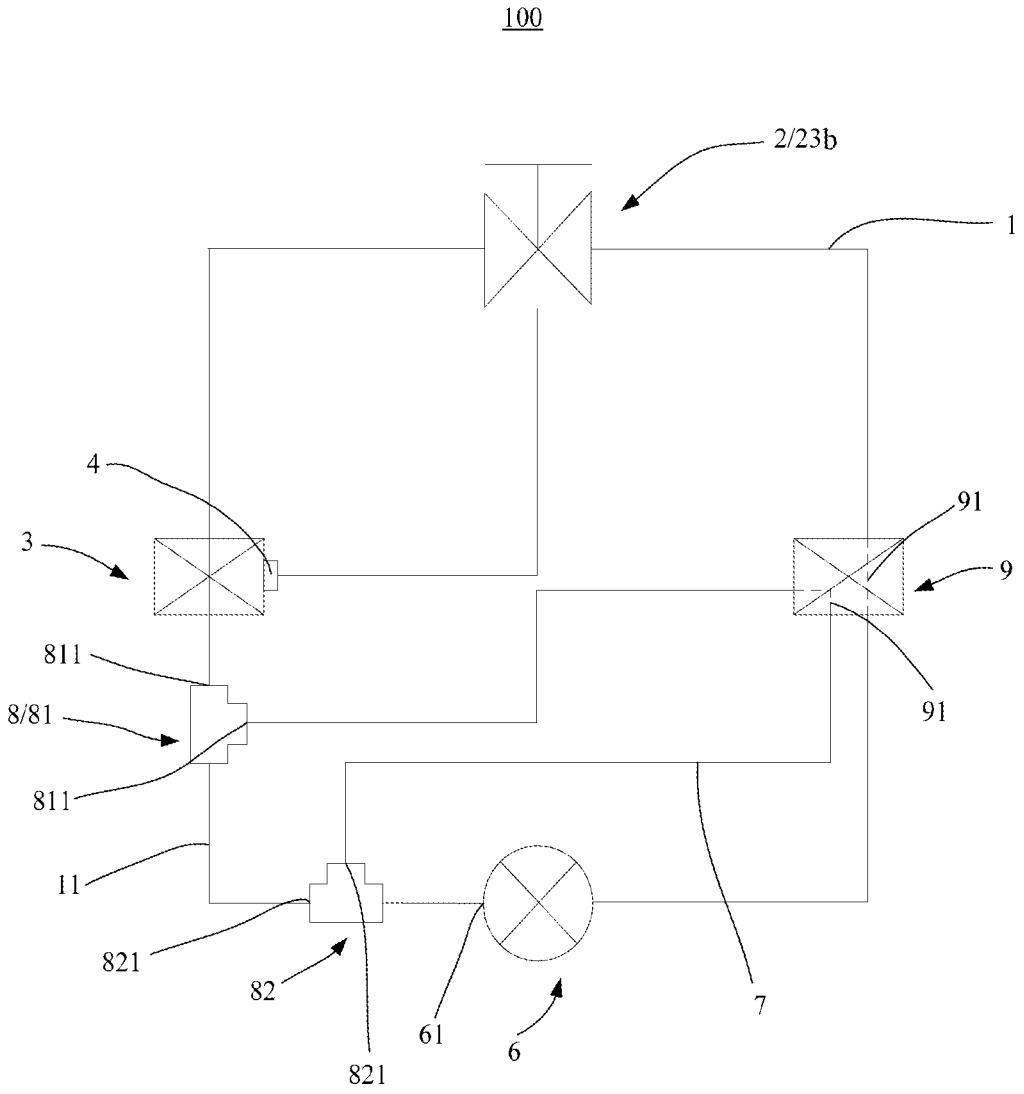
FIG. 1 is a schematic structural diagram of a refrigerator cooling system according to a first embodiment of the present disclosure.

| Reference sign | Name |
|---|---|
| 100 | refrigerator cooling system |
| 1 | refrigerant circulation flow path |
| 11 | backflow trunk section |
| 2 | throttling device |
| 21 | first three-way valve |
| 211 | first communication port |
| 22 | throttling branch |
| 23a | electronic expansion valve |
| 23b | capillary tube |
| 3 | evaporator |
| 4 | temperature sensor |
| 6 | compressor |
| 61 | air return port |
| 7 | gasification branch |
| 8 | switching structure |
| 81 | second three-way valve |
| 811 | second communication port |
| 82 | third three-way valve |
| 821 | third communication port |
| 9 | condenser |
| 91 | heat exchange tube |
| a | circulation flow path in the throttling mode |
| b | circulation flow path in the defrosting mode |

The realization of the technical benefits, functional characteristics, and advantages of the present disclosure are further described with reference to the accompanying drawings.

DETAILED DESCRIPTION OF THE EMBODIMENTS

The technical solutions of the embodiments of the present disclosure will be described in detail below with reference to the accompanying drawings. It is obvious that the embodiments described are only some rather than all of the embodiments of the present disclosure. All other embodiments obtained by those skilled in the art based on the embodiments of the present disclosure without creative efforts shall fall within the claimed scope of the present disclosure.

It should be noted that all the directional indications (such as up, down, left, right, front, rear . . . ) in the embodiments of the present disclosure are only used to explain the relative positional relationship, movement, or the like of the components in a certain posture (as shown in the drawings). If the specific posture changes, the directional indication will change accordingly.

Besides, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. In addition, the technical solutions of the various embodiments can be combined with each other, but the combinations must be based on the realization of those skilled in the art. When the combination of technical solutions is contradictory or cannot be achieved, it should be considered that such a combination of technical solutions does not exist, nor does it fall within the scope of the present disclosure.

The existing defrosting technology applied in air-cooled refrigerators is mainly realized by a defrosting heater and a defrosting control system, which adopts an external heater, resulting in a high energy consumption and a poor user experience.

In view of this, the present disclosure provide a refrigerator cooling system 100, and FIGS. 1 to 6 are schematic structural diagrams of a refrigerator cooling system 100 according to embodiments of the present disclosure.

Figure 4:
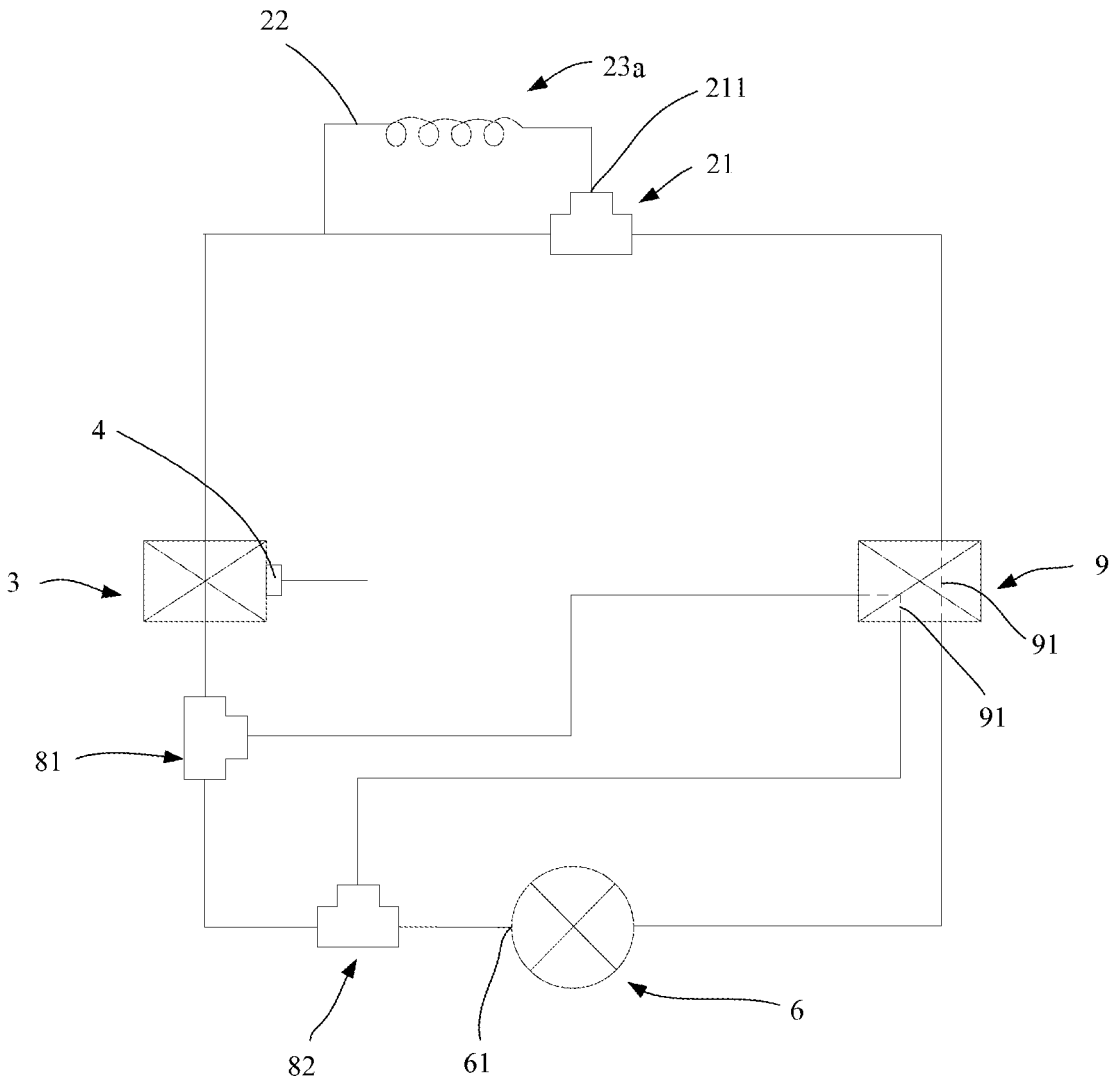
FIG. 4 is a schematic structural diagram of the refrigerator cooling system according to a second embodiment of the present disclosure.

As shown in FIG. 1 and FIG. 4, the refrigerator cooling system 100 includes a refrigerant circulation flow path 1 provided with a compressor 6, a condenser 9, a throttling device 2 and an evaporator 3. The throttling device 2 has a throttling working mode and a defrosting working mode, and the throttling working mode and the defrosting working mode are switched with each other. Correspondingly, the condenser 9 has a first heat release mode and a second heat release mode. A heat release amount of a refrigerant flowing through the condenser 9 in the second heat release mode is lower than a heat release amount of the refrigerant flowing through the condenser 9 in the first heat release mode.

In the technical solution of the present disclosure, the refrigerant circulation flow path 1 is provided with a compressor 6, a condenser 9, a throttling device 2 and an evaporator 3. The throttling device 2 has a throttling working mode for cooling and a defrosting working mode not used for cooling, and the throttling working mode and the defrosting working mode are switched with each other. The condenser 9 has a first heat release mode corresponding to the throttling working mode and a second heat release mode corresponding to the defrosting working mode. In the throttling working mode, a heat release amount of a refrigerant flowing through the condenser 9 is high and the refrigerant in the throttle device 2 is greatly cooled. In this case, the temperature of the refrigerant is relatively low, and the refrigerant flows through the evaporator 3 to cool the refrigerator. In a defrosting working mode, a heat release amount of a refrigerant flowing through the condenser 9 is low and the refrigerant in the throttle device 2 is less cooled. In this case, the temperature of the refrigerant is relatively high, and the internal circulation of the refrigerant can be directly used for defrosting, which not only reduces the use of external heaters and has a high heating efficiency and a high defrosting speed, but also saves electric energy and improves the user experience.

It should be noted that the switching of the throttling device 2 between the throttling working mode and the defrosting working mode may be referenced to the time parameter. For example, after working in the throttling working mode for a period of time, the throttling device 2 may be switched from the throttling working mode to the defrosting working mode. Or after working in the defrosting working mode for a period of time, the throttling device 2 may be switched from the defrosting working mode to the throttling working mode. Of course, the switching of the throttling device 2 between the throttling working mode and the defrosting working mode may be referenced to the temperature parameter. For example, after the throttling device 2 works in the throttling working mode for a period of time and a surface temperature of the evaporator 3 is lower than the first preset temperature, the throttling device 2 may be switched from the throttling working mode to the defrosting working mode. Or after the throttling device 2 works in the defrosting working mode for a period of time and a surface temperature of the evaporator 3 is higher than the second preset temperature, the throttling device 2 may be switched from the defrosting working mode to the throttling working mode.

In the technical solution of the present disclosure, the switching of the throttling device 2 between the throttling working mode and the defrosting working mode is considered by combining the time parameter and the temperature parameter. After working in the throttling working mode for a period of time, the throttling device 2 may be switched from the throttling working mode to the defrosting working mode. After the throttling device 2 works in the defrosting working mode for a period of time and a surface temperature of the evaporator 3 is higher than the second preset temperature, the throttling device 2 may be switched from the defrosting working mode to the throttling working mode. In an embodiment, the refrigerator cooling system 100 further includes a temperature sensor 4 and a control component. The temperature sensor 4 is configured to detect a surface temperature of the evaporator 3. The control component electrically connected to the temperature sensor 4 and the throttling device 2, is configured to switch the throttling device 2 from the defrosting working mode to the throttling working mode according to a temperature obtained by the temperature sensor 4. In this way, the switching of the throttling device 2 between the throttling working mode and the defrosting working mode may be more intelligent.

Figure 2:
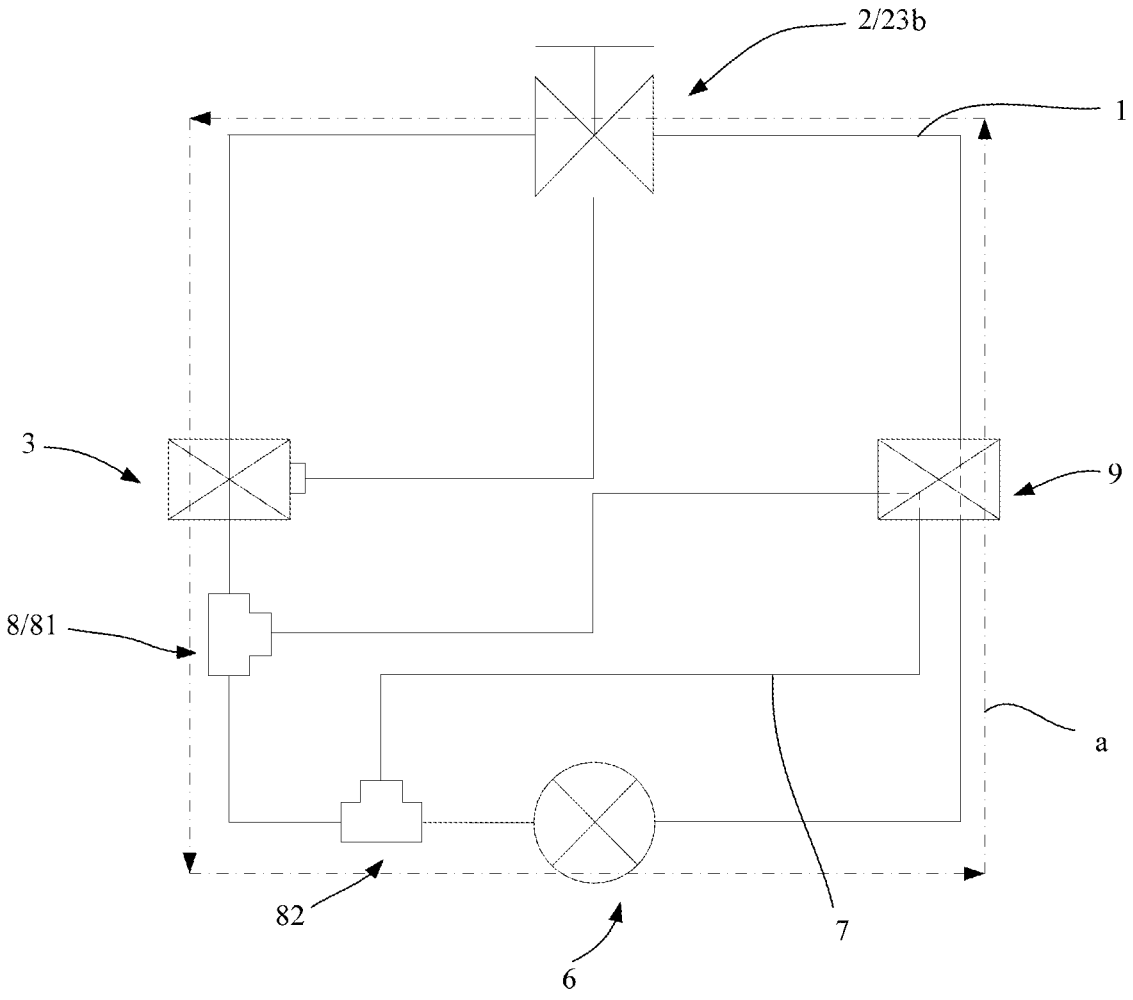
FIG. 2 is a schematic diagram of a refrigerant flow path of a throttling device in a throttling working mode shown in FIG. 1.
Figure 3:
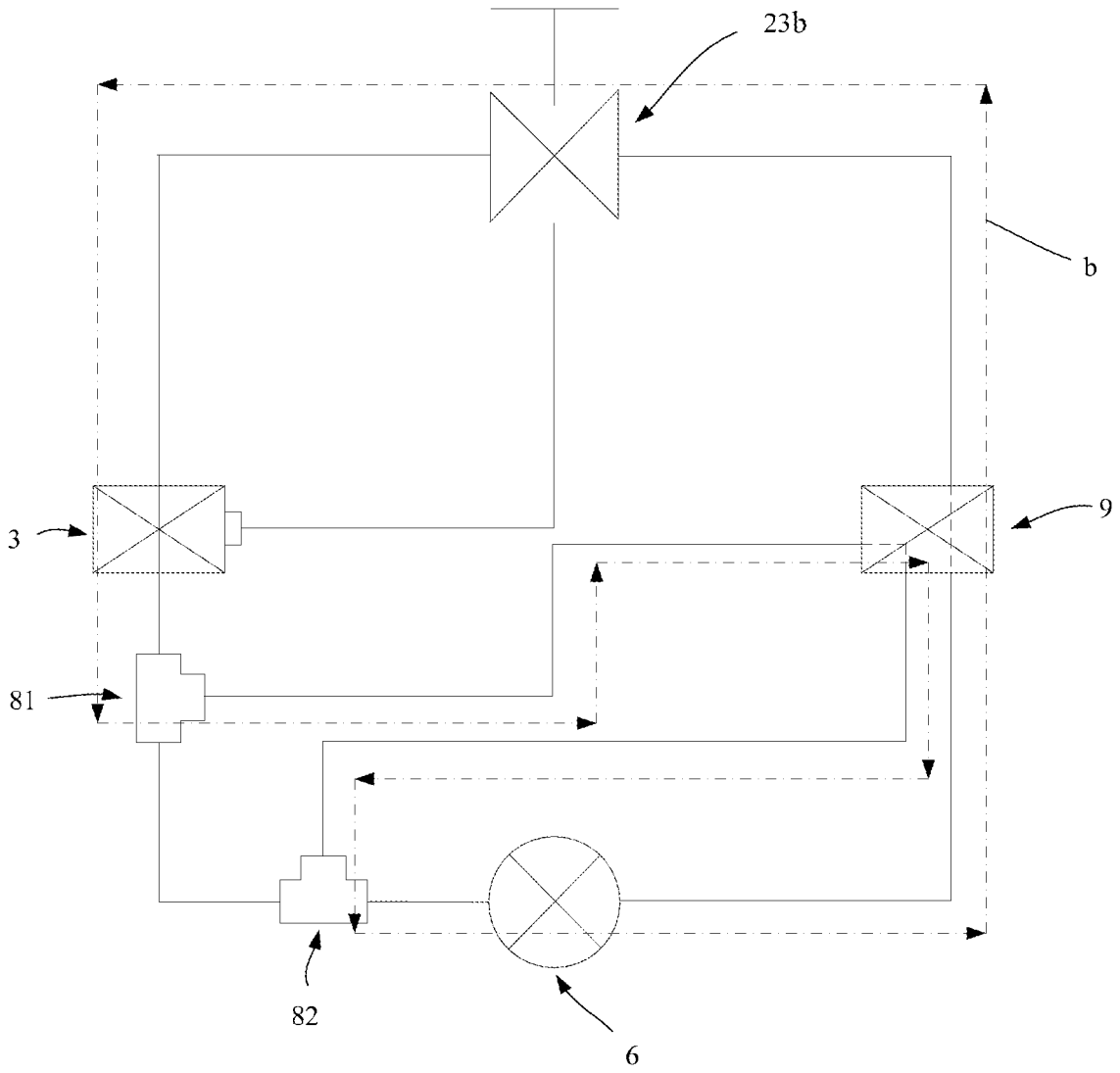
FIG. 3 is a schematic diagram of a refrigerant flow path of a throttling device in a defrosting working mode shown in FIG. 1.

The throttling device 2 has a throttling working mode and a defrosting working mode, and the throttling working mode and the defrosting working mode can be switched by an electronic expansion valve 23*b* in a high flow mode, or by combining a capillary tube 23*a* and a three-way valve. As shown in FIGS. 1 to 3, the electronic expansion valve 23*b* in the high flow mode is adopted to switch the throttling working mode and the defrosting working mode. In response that the throttling device is in the throttling working mode, the electronic expansion valve 23*b* is provided with a first opening degree to throttle the refrigerant flowing through the electronic expansion valve 23*b*. In response that the throttling device is in the defrosting working mode, the electronic expansion valve 23*b* is provided with a second opening degree bigger than the first opening degree, to reduce a throttling of the refrigerant flowing through the electronic expansion valve 23*b* relative to the throttling working mode. In response that the throttling device is in the throttling working mode, the electronic expansion valve 23*b* cools down and depressurizes the refrigerant with high temperature and high pressure on the refrigerant circulation flow path 1. In response that the throttling device is in the defrosting mode, the electronic expansion valve 23*b* turns on a high flow mode and does not process the refrigerant flowing through the electronic expansion valve 23*b*, thus the refrigerant is still in a high temperature and high pressure state. In this case, the evaporator 3 may be heated by the refrigerant when the refrigerant flows through the evaporator 3, and a defrosting operation may be performed. It should be noted that the second opening degree of the electronic expansion valve 23*b* may be a specific opening degree value or may be in an opening degree range. For example, the electronic expansion valve 23*b* with a second opening degree may be in a fully open state, and may not cool down and depressurize the refrigerant flowing through the electronic expansion valve 23*b*. Of course, the opening degree of the electronic expansion valve 23*b* may be smaller than that of the electronic expansion valve 23*b* in the fully open state, or may be larger than that of the electronic expansion valve 23*b* in the throttling working mode.

Figure 5:
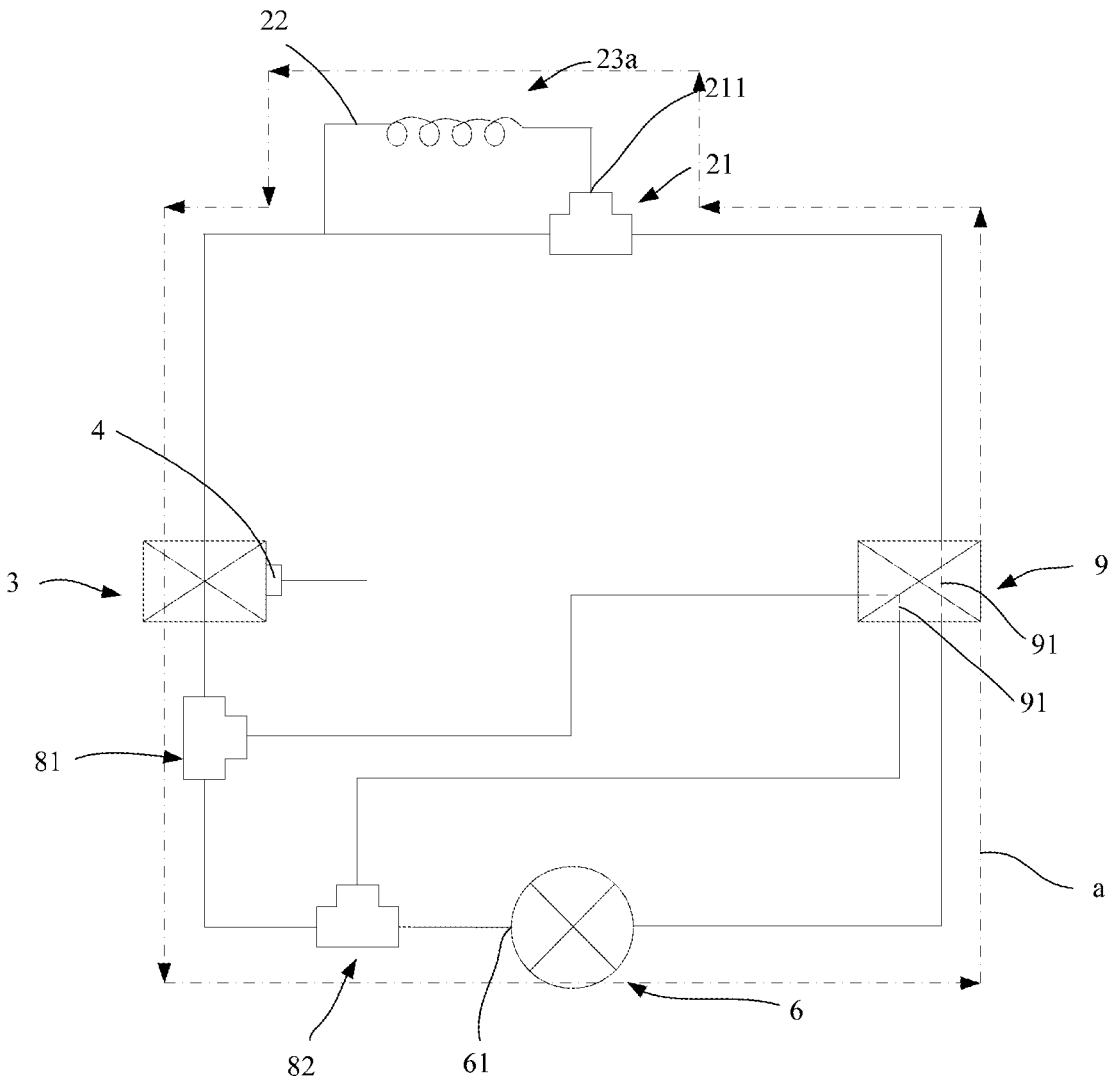
FIG. 5 is a schematic diagram of a refrigerant flow path of a throttling device in a throttling working mode shown in FIG. 4.
Figure 6:
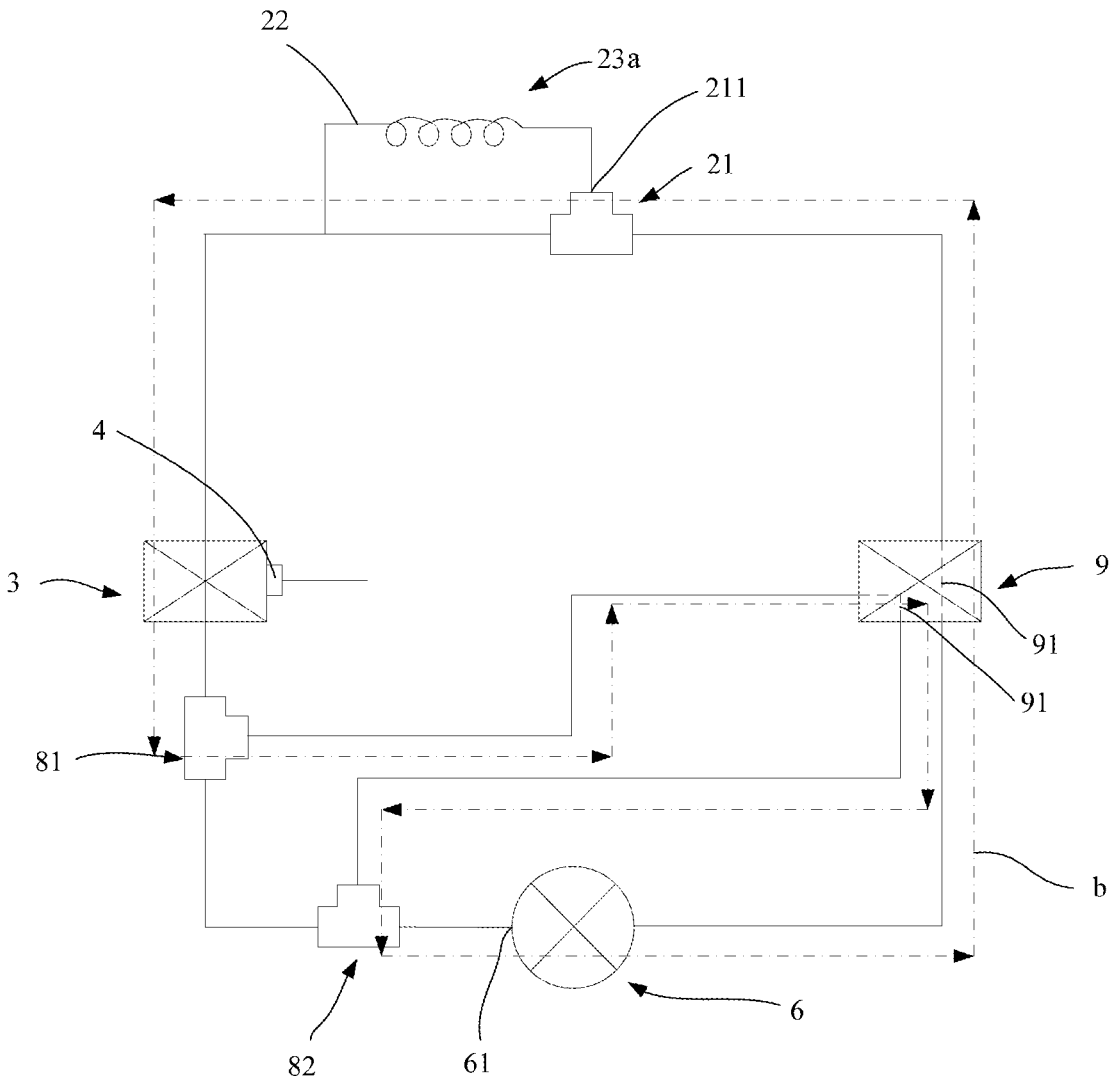
FIG. 6 is a schematic diagram of a refrigerant flow path of a throttling device in a defrosting working mode shown in FIG. 4.

As shown in FIGS. 4 to 6, the throttling working mode and the defrosting working mode is switched by combining a capillary tube 23*a* and a three-way valve. The throttling device 2 includes a first three-way valve 21 and a throttling branch 22. The first three-way valve 21 is provided with three first communication ports 211 communicated with each other, and two of the three first communication ports 211 are communicated with the refrigerant circulation flow path 1. The throttling branch 22 is provided with a capillary tube 23*a*. An end of the throttling branch 22 is communicated with a remaining first communication port 211, and another end of the throttling branch 22 is communicated with the evaporator 3. In response that the throttling device is in the throttling working mode, the first three-way valve 21 switches the refrigerant on the refrigerant circulation flow path 1 from the condenser 9 to flow through the throttling branch 22, and then flow through the evaporator 3. In response that the throttling device is in the defrosting working mode, the first three-way valve 21 switches the refrigerant on the refrigerant circulation flow path 1 from the condenser 9 to directly flow through the evaporator 3. That is, in response that the throttling device is in the throttling working mode, the three-way valve switches the refrigerant circulation flow path 1 to communicate with the throttling branch 22. In this case, the capillary tube 23*a* cools down and depressurizes the refrigerant on the throttling branch 22, to enable the evaporator 3 to supply cooling normally. In response that the throttling device is in the defrosting working mode, the three-way valve switches the refrigerant on the refrigerant circulation flow path 1 not to flow through the throttling branch 22. In this case, the refrigerant is not cooled down and depressurized, and when the refrigerant flows through the evaporator 3, the evaporator 3 is defrosted by the refrigerant.

In an embodiment, the first three-way valve 21 is an electromagnetic three-way valve. By providing an electromagnetic three-way valve as the first three-way valve 21, the first three-way valve 21 may be controlled conveniently and automatically, which makes the automation degree high and improves the user experience.

In response that the throttling device is in the defrosting working mode, the refrigerant flowing through the evaporator 3 has a relatively high temperature and is in a liquid state. When the liquid refrigerant flows back to the compressor 6 on the refrigerant circulation flow path 1, the compressor 6 performance may be damaged. In this case, the refrigerant flowing back to the compressor 6 needs to be heated and gasified to protect the compressor 6.

In an embodiment, the refrigerator cooling system 100 further includes a backflow trunk section 11, a gasification branch and a switching structure 8. The backflow trunk section 11 is communicated with the evaporator 3 and the compressor 6. The gasification branch is provided in parallel with the backflow trunk section 11, and a heating device is provided on the gasification branch 7 to gasify a liquid refrigerant. In response that the throttling device is in the throttling working mode, the switching structure 8 switches the refrigerant from the backflow trunk section 11 to flow back to the compressor 6. In response that the throttling device is in defrosting working mode, the switching structure 8 switches the refrigerant from the gasification branch to flow back to the compressor 6. In this way, the refrigerant flowing back to the compressor 6 is in a gaseous state, which protects the compressor 6.

The refrigerant on the gasification branch 7 may be heated by an external heating device, such as a heating wire or a semiconductor heating sheet, etc. In an embodiment, the refrigerator cooling system 100 further includes a condenser 9, and the condenser 9 is provided with two heat exchange tubes 91. One of the two heat exchange tubes 91 is provided on the refrigerant circulation flow path 1 and located between the compressor 6 and the throttling device 2. The heating device includes at least another of the two heat exchange tubes 91. In this way, the heat of the condenser 9 in the refrigerator cooling system 100 may be fully utilized, and the energy-saving effect is good.

The switching structure 8 switches the refrigerant from one of the backflow trunk section 11 and the gasification branch 7 to the air return port 61 of the compressor 6. In an embodiment, the switching structure 8 includes a second three-way valve 81 and a third three-way valve 82. The second three-way valve 81 is provided with three second communication ports 811 communicated with each other, and two of the three second communication ports 811 are communicated with the backflow trunk section 11. The third three-way valve 82 is provided with three third communication ports 821 communicated with each other, and two of the three third communication ports 821 are communicated with the backflow trunk section 11. Both ends of the gasification branch 7 are respectively communicated with a remaining second communication port 811 and a remaining third communication port 821. Through the mutual cooperation of the second three-way valve 81 and the third three-way valve 82, the refrigerant can be well switched from one of the backflow trunk section 11 and the gasification branch 7 to the air return port 61 of the compressor 6, which is convenient for gasifying the refrigerant flowing through the gasification branch in the defrosting mode.

In an embodiment, the second three-way valve 81 and/or the third three-way valve 82 are electromagnetic three-way valves. Both the second three-way valve 81 and/or the third three-way valve 82 may be electromagnetic three-way valve, which not only enable the second three-way valve 81 and the third three-way valve 82 to be controlled conveniently and automatically, but also makes the automation degree high and improves the user experience.

Through describing the corresponding flow directions of the refrigerant on the refrigerant circulation flow path 1 and the operations of the throttling devices 2 and the three-way valves in the following embodiments, a principle of the switching of the refrigerator cooling system 100 between the throttling mode and the defrosting mode will be described as follows.

1. As shown in FIG. 2, a circulation flow path a in the throttling mode is provided. In FIG. 2, the electronic expansion valve 23*b* is in a throttling mode. The refrigerant in the compressor 6 flows through the condenser 9 to form a liquid refrigerant with high temperature and high pressure, and after the liquid refrigerant with high temperature and high pressure flows through the throttling device 2, a liquid refrigerant with low temperature and low pressure is formed. After the liquid refrigerant with low temperature and low pressure flows through the evaporator 3, a gaseous refrigerant with low temperature and low pressure is formed, and then the gaseous refrigerant with low temperature and low pressure flows back to the compressor 6.

2. As shown in FIG. 3, a circulation flow path b in the defrosting mode is provided. In FIG. 3, the electronic expansion valve 23*b* is in a high flow mode. The refrigerant in the compressor 6 flows through the condenser 9 to form a liquid refrigerant with high temperature and high pressure, and after the liquid refrigerant with high temperature and high pressure flows through the throttling device 2, the refrigerant remains to be the liquid refrigerant with high temperature and high pressure. After the liquid refrigerant with high temperature and high pressure flows through the evaporator 3, a liquid refrigerant with low temperature and high pressure is formed. After the liquid refrigerant with low temperature and high pressure flows through and back to the compressor 6, a gaseous refrigerant with medium temperature and high pressure is formed, and then the gaseous refrigerant with medium temperature and high pressure flows back to the compressor 6.

3. As shown in as shown in FIG. 5, a circulation flow path a in the throttling mode is provided. In FIG. 5, the first three-way valve 21 switches the refrigerant on the refrigerant circulation flow path 1 to flow through the capillary tube 23*a*. The refrigerant in the compressor 6 flows through the condenser 9 to form a liquid refrigerant with high temperature and high pressure. After the liquid refrigerant with high temperature and high pressure flows through the throttling device 2, a liquid refrigerant with low temperature and low pressure is formed. After the liquid refrigerant with low temperature and low pressure flows through the evaporator 3, a gaseous refrigerant with low temperature and low pressure is formed, and then the gaseous refrigerant with low temperature and low pressure flows back to the compressor 6.

4. As shown in FIG. 6, a circulation flow path b in the defrosting mode is provided. In FIG. 6, the first three-way valve 21 switches the refrigerant on the refrigerant circulation flow path 1 not to flow through the capillary tube 23*a*. The refrigerant in the compressor 6 flows through the condenser 9 to form a liquid refrigerant with high temperature and high pressure, and then the liquid refrigerant with high temperature and high pressure is directly input the evaporator 3 to form a liquid refrigerant with low temperature and high pressure. After the liquid refrigerant with low temperature and high pressure flows through and back to the condenser 9, a gaseous refrigerant with medium temperature and high pressure is formed, and then the gaseous refrigerant with medium temperature and high pressure flows back to the compressor 6.

Figure 7:
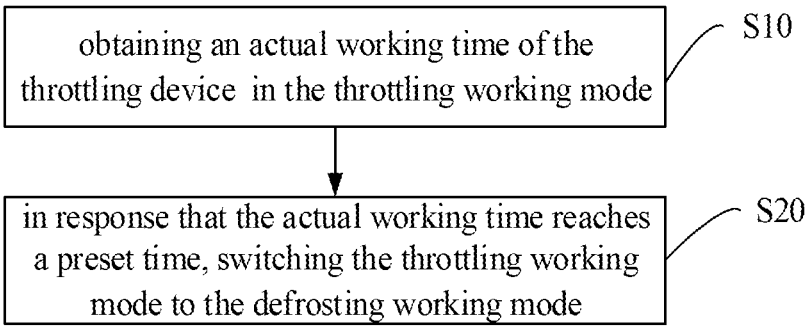
FIG. 7 is a schematic flowchart of a method for defrosting a refrigerator according to a first embodiment of the present disclosure.
Figure 8:
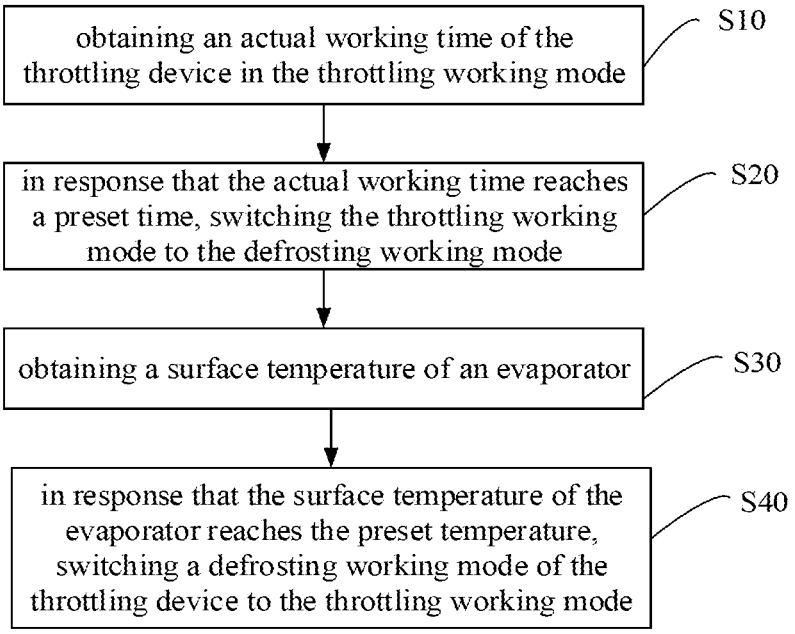
FIG. 8 is a schematic flowchart of a method for defrosting a refrigerator according to a second embodiment of the present disclosure.
Figure 9:
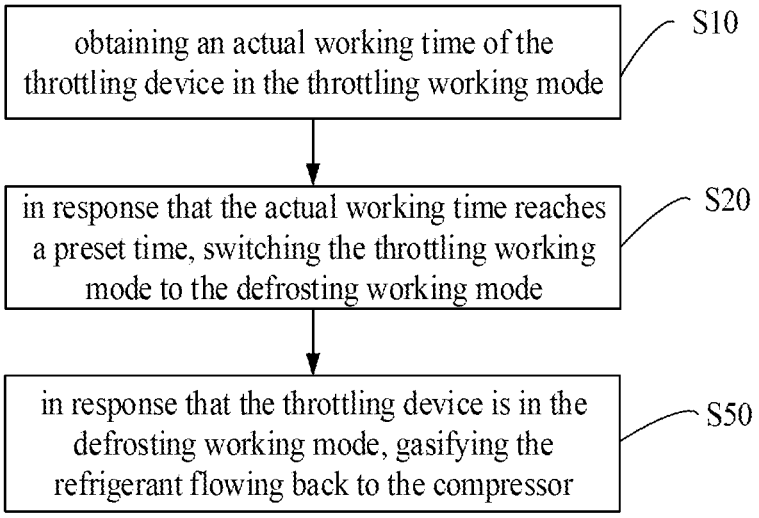
FIG. 9 is a schematic flowchart of a method for defrosting a refrigerator according to a third embodiment of the present disclosure.

The present disclosure further provides a method for defrosting a refrigerator, FIGS. 7 to 9 are schematic flowcharts of a method for defrosting a refrigerator according to embodiments of the present disclosure.

As shown in FIG. 7, FIG. 7 is a schematic flowchart of a method for defrosting a refrigerator according to a first embodiment of the present disclosure. The method for defrosting a refrigerator includes following operations.

S10, obtaining an actual working time of the throttling device 2 in the throttling working mode.

It should be noted that the refrigerator cooling system 100 needs to provide cooling to the refrigerating chamber and the freezing chamber. After a long time of operation, the refrigerator will frost. The actual working time of the refrigerator cooling system 100 in the throttling working mode can be measured by a timer.

S20, in response that the actual working time reaches a preset time, switching the throttling working mode to the defrosting working mode.

It should be noted that after a long time of operation, the refrigerator will frost. In this case, the refrigerator needs to be defrosted. The defrosting mode of the refrigerator can be started by setting a preset time. For example, the preset time can be 6 h, 8 h, 10 h, 12 h, etc. Of course, the preset time can be considered according to the actual working environment of the refrigerator. The actual working environment may be a humidity environment. Different humidity environment corresponds to different preset time. When the actual time reaches the preset time, the defrosting working mode can be automatically started for defrosting.

In the technical solution of the present disclosure, obtaining the actual working time of the throttling device 2 in the throttling working mode, and in response that the actual working time reaches the preset time, switching the throttling working mode to the defrosting working mode. The internal circulation of the refrigerant can be directly used for defrosting, which not only reduces the use of external heaters and has a high heating efficiency and a high defrosting speed, but also saves electric energy and improves the user experience.

As shown in FIG. 8, FIG. 8 is a schematic flowchart of a method for defrosting a refrigerator according to a second embodiment of the present disclosure.

In the embodiment, relative to the method for defrosting a refrigerator mentioned in the first embodiment, the method further includes following operations.

S30, obtaining a surface temperature of an evaporator 3.

It should be noted that, in the whole refrigerator cooling system 100, the evaporator 3 provides cooling to the refrigerating chamber and the freezing chamber of the refrigerator. During a long-term operation of the evaporator 3, a corresponding part of the evaporator 3 will frost. By detecting the surface temperature of the evaporator 3 of the refrigerator, the frosting degree of the refrigerator can be known. The surface temperature of the evaporator 3 is usually obtained by the temperature sensor 4.

S40, in response that the surface temperature of the evaporator 3 reaches the preset temperature, switching a defrosting working mode of the throttling device 2 to the throttling working mode.

It should be noted that a reference temperature can be preset according to the statistical data. For example, below a preset temperature, the frosting degree is relatively serious and the refrigerator needs to be defrosted. Above the preset temperature, the frosting degree is not serious, and the refrigerator does not need to be defrosted.

It should be noted that the above-mentioned method for defrosting a refrigerator is implemented based on the structure in the above-mentioned embodiment of the refrigerator cooling system 100.

In the technical solution of the present disclosure, obtaining the surface temperature of an evaporator 3, and in response that the surface temperature of the evaporator 3 reaches the preset temperature, switching a defrosting working mode of the throttling device 2 to the throttling working mode. In this way, the defrosting working mode is automatically switched to the throttling working mode, which is convenient for the automatic operation of the system.

As shown in FIG. 9, FIG. 9 is a schematic flowchart of a method for defrosting a refrigerator according to a third embodiment of the present disclosure.

In the embodiment, relative to the method for defrosting a refrigerator mentioned in the first embodiment, the method further includes following operations.

S50, in response that the throttling device 2 is in the defrosting working mode, gasifying the refrigerant flowing back to the compressor 6.

It should be noted that gasifying the refrigerant flowing back to the compressor 6 makes the refrigerant flowing into the compressor 6 in a gaseous state, thereby reducing the risk of damage to the compressor 6.

In addition, as shown in FIG. 2 and FIG. 3, the technical solution of the present disclosure is realized by switching the gasification branch and the backflow trunk and communicating an air return port 61 of the compressor 6 with one of the gasification branch and the backflow trunk. Specifically, the refrigerator cooling system 100 further includes a compressor 6 provided with an air return port 61, and the air return port 61 is communicated with the evaporator 3. The refrigerant circulation flow path 1 is provided with the backflow trunk section 11 between the air return port 61 and the evaporator 3. The refrigerator cooling system 100 further includes the gasification branch and the switching structure 8. The gasification branch is provided in parallel with the backflow trunk section 11, and a heating device is provided on the gasification branch 7 to gasify a liquid refrigerant. In response that the throttling device is in the throttling working mode, the switching structure 8 switches the refrigerant from the backflow trunk section 11 to flow back to the compressor 6. In response that the throttling device is in defrosting working mode, the switching structure 8 switches the refrigerant from the gasification branch to flow back to the compressor 6. The switching structure 8 is electrically connected the control component. Based on the above structure, in response that the throttling device is in the defrosting working mode, the throttling device 2 controls the switching structure 8 to switch the refrigerant from the gasification branch to flow back to the compressor 6, to gasify the refrigerant flowing back to the compressor 6.

In the technical solution of the present disclosure, in response that the throttling device is in the throttling working mode, the throttling device 2 controls the switching structure 8 to switch the refrigerant from the backflow trunk section 11 to flow back to the compressor 6. In response that the throttling device is in the defrosting working mode, the throttling device 2 controls the switching structure 8 to switch the refrigerant from the gasification branch to flow back to the compressor 6. The refrigerant can be switched well from one of the gasification branch and the backflow trunk to an air return port 61 of the compressor 6, which not only makes it easy to gasify the refrigerant flowing through the compressor 6 in the defrosting mode, but also protects the compressor 6 and improves the service life of the compressor 6, thereby providing a better effect.

The above are only preferred embodiments of the present disclosure and are not to limit the scope of the present disclosure. Under the concept of the present disclosure, any equivalent structural transformations made by using the contents of the description and drawings of the present disclosure, or any direct or indirect application to other related technical fields is included in the scope of the present disclosure.

What is claimed is:

1. A refrigerator cooling system, comprising:

a refrigerant circulation flow path provided with a compressor, a condenser, a throttling device and an evaporator;

a backflow trunk section in communication with the evaporator and the compressor;

a gasification branch provided in parallel with the backflow trunk section;

a heating device provided on the gasification branch to gasify a liquid refrigerant; and a switching structure, wherein the throttling device has a throttling working mode and a defrosting working mode, and a working mode of the throttle device is configured to switch between the throttling working mode and the defrosting working mode;

wherein the condenser has a first heat release mode corresponding to the throttling working mode and a second heat release mode corresponding to the defrosting working mode, and a heat release amount of a refrigerant flowing through the condenser in the second heat release mode is smaller than a heat release amount of the refrigerant flowing through the condenser in the first heat release mode, in response to the throttling device being in the throttling working mode, the switching structure switches the refrigerant from the backflow trunk section to flow back to the compressor; and in response to the throttling device being in the defrosting working mode, the switching structure switches the refrigerant from the gasification branch to flow back to the compressor.

2. The refrigerator cooling system of claim 1, further comprising:

a temperature sensor configured to detect a surface temperature of the evaporator; and a control component electrically connected to the temperature sensor and the throttling device, the control component configured to switch the working mode of the throttling device according to a temperature obtained by the temperature sensor.

3. The refrigerator cooling system of claim 1, wherein the heating device comprises a heater.

4. The refrigerator cooling system of claim 1, comprising:

two heat exchange tubes, wherein one of the two heat exchange tubes is provided in the refrigerant circulation flow path and located between the compressor and the throttling device; and the heating device comprises at least another one of the two heat exchange tubes.

5. The refrigerator cooling system of claim 1, wherein the switching structure comprises:

a second three-way valve including three second communication ports in communication with one another, two of the three second communication ports in communication with the backflow trunk section; and a third three-way valve including three third communication ports in communication with one another, two of the three third communication ports in communication with the backflow trunk section, and wherein both ends of the gasification branch are respectively in communication with a remaining second communication port and a remaining third communication port.

6. The refrigerator cooling system of claim 5, wherein one or more of the second three-way valve or the third three-way valve are electromagnetic three-way valves.

7. The refrigerator cooling system of claim 1, wherein:

the throttling device comprises an electronic expansion valve, in response to the throttling device being in the throttling working mode, the electronic expansion valve is configured to operate with a first opening degree to throttle the refrigerant flowing through the electronic expansion valve, and in response to the throttling device being in the defrosting working mode, the electronic expansion valve is configured to operate with a second opening degree bigger than the first opening degree, to reduce a throttling of the refrigerant flowing through the electronic expansion valve relative to the throttling working mode.

8. The refrigerator cooling system of claim 1, wherein the throttling device comprises:

a first three-way valve including three first communication ports in communication with one another, two of the three first communication ports in communication with the refrigerant circulation flow path; and a throttling branch including a capillary tube, an end of the throttling branch in communication with a remaining first communication port, another end of the throttling branch in communication with the evaporator, wherein:

in response to the throttling device being in the throttling working mode, the first three-way valve switches the refrigerant on the refrigerant circulation flow path from the condenser to flow through the throttling branch, and then flow through the evaporator; and in response to the throttling device being in the defrosting working mode, the first three-way valve switches the refrigerant on the refrigerant circulation flow path from the condenser to directly flow through the evaporator.

9. The refrigerator cooling system of claim 8, wherein the first three-way valve is an electromagnetic three-way valve.

10. A method for defrosting a refrigerator, applied to a refrigerator cooling system of the refrigerator having a throttle device, an evaporator, a compressor, a condenser, a backflow trunk section in communication with the evaporator and the compressor and a gasification branch provided in parallel with the backflow trunk section, the method comprising:

obtaining an actual working time of the throttling device in a throttling working mode; and in response to that the actual working time reaches a preset time, switching a working mode of the throttling device from the throttling working mode to a defrosting working mode;

in response to the throttling device being in the throttling working mode, switching the refrigerant from the backflow trunk section to flow back to the compressor; and in response to the throttling device being in the defrosting working mode, switching the refrigerant from the gasification branch to flow back to the compressor, wherein the condenser has a first heat release mode corresponding to the throttling working mode and a second heat release mode corresponding to the defrosting working mode, and a heat release amount of a refrigerant flowing through the condenser in the second heat release mode is smaller than a heat release amount of the refrigerant flowing through the condenser in the first heat release mode.

11. The method of claim 10, further comprising:

obtaining the surface temperature of the evaporator when the throttling device is in the defrosting working mode; and in response to that the surface temperature of the evaporator reaches a preset temperature, switching the working mode of the throttling device from the defrosting working mode to the throttling working mode.

12. The method of claim 10, further comprising:

in response that the throttling device is in the defrosting working mode, gasifying the refrigerant flowing back to the compressor.

13. The method of claim 12, wherein the gasifying the refrigerant includes heating the refrigerant.

14. The method of claim 10, wherein the throttling device comprises an electronic expansion valve, and wherein the method comprises:

in response to the throttling device being in the throttling working mode, operating the electronic expansion valve with a first opening degree to throttle the refrigerant flowing through the electronic expansion valve, and in response to the throttling device being in the defrosting working mode, operating the electronic expansion valve with a second opening degree bigger than the first opening degree, to reduce a throttling of the refrigerant flowing through the electronic expansion valve relative to the throttling working mode.

15. The method of claim 10, wherein the throttling device comprises:

a first three-way valve including three first communication ports in communication with one another, two of the three first communication ports in communication with the refrigerant circulation flow path; and a throttling branch including a capillary tube, an end of the throttling branch in communication with a remaining first communication port, another end of the throttling branch in communication with the evaporator, and wherein the method comprises:

in response to the throttling device being in the throttling working mode, operating the first three-way valve to switch the refrigerant on the refrigerant circulation flow path from the condenser to flow through the throttling branch, and then flow through the evaporator; and in response to the throttling device being in the defrosting working mode, operating the first three-way valve to switch the refrigerant on the refrigerant circulation flow path from the condenser to directly flow through the evaporator.

16. A refrigerator cooling system, comprising:

a refrigerant circulation flow path provided with a compressor, a condenser, a throttling device and an evaporator, wherein the throttling device comprises:

a first three-way valve including three first communication ports in communication with one another, two of the three first communication ports in communication with the refrigerant circulation flow path; and a throttling branch including a capillary tube, an end of the throttling branch in communication with a remaining first communication port, another end of the throttling branch in communication with the evaporator, wherein:

the throttling device has a throttling working mode and a defrosting working mode, and a working mode of the throttle device is configured to switch between the throttling working mode and the defrosting working mode;

in response to the throttling device being in the throttling working mode, the first three-way valve switches the refrigerant on the refrigerant circulation flow path from the condenser to flow through the throttling branch, and then flow through the evaporator; and in response to the throttling device being in the defrosting working mode, the first three-way valve switches the refrigerant on the refrigerant circulation flow path from the condenser to directly flow through the evaporator; and wherein the condenser has a first heat release mode corresponding to the throttling working mode and a second heat release mode corresponding to the defrosting working mode, and a heat release amount of a refrigerant flowing through the condenser in the second heat release mode is smaller than a heat release amount of the refrigerant flowing through the condenser in the first heat release mode.

* * * * *